US005552252A

United States Patent [19]

Lundy et al.

[11] Patent Number: 5,552,252

[45] Date of Patent: Sep. 3, 1996

[54] MAGNETIC TONER IMAGING

[75] Inventors: Douglas A. Lundy; Joseph R. Matalevich, Webster; Michael J. Cortash, Walworth; Michael L. Grande, Palmyra, all of N.Y.

[73] Assignee: Xerox Corporation, Stamford, Conn.

[21] Appl. No.: 413,581

[22] Filed: Mar. 30, 1995

[51] Int. Cl.[6] ..... G03G 13/09

[52] U.S. Cl. ..... 430/39; 430/106; 430/106.6; 430/110; 430/137

[58] Field of Search ..... 430/106, 106.6, 430/110, 39, 137

[56] References Cited

U.S. PATENT DOCUMENTS

| | | | |
|---|---|---|---|
| Re. 33,172 | 2/1990 | Gruber et al. | 430/39 |
| 5,158,851 | 10/1992 | Fuller et al. | 430/106 |
| 5,266,433 | 11/1993 | Ishida et al. | 430/110 |
| 5,292,609 | 3/1994 | Yoshikawa et al. | 430/110 |
| 5,296,324 | 3/1994 | Akagi et al. | 430/106 |
| 5,306,588 | 4/1994 | Tanaka et al. | 430/110 |
| 5,476,741 | 12/1995 | Nishikiori et al. | 430/109 |

*Primary Examiner*—Roland Martin
*Attorney, Agent, or Firm*—E. O. Palallo

[57] ABSTRACT

A process for avoiding or minimizing comet formation which comprises dispersing in a magnetic toner comprised of resin particles, a first magnetite, carbon black, charge additive, and wax, a second soft magnetite; and wherein the toner contains a silica surface additive.

16 Claims, No Drawings

MAGNETIC TONER IMAGING

BACKGROUND OF THE INVENTION

The invention is generally directed to toner and developer compositions, and more specifically, the present invention is directed to developer and toner compositions containing charge enhancing additives which impart or assist in imparting a positive charge to the toner resin particles and enable toners with rapid admix characteristics, and wherein there is selected as the primary toner pigment a magnetite, especially an acicular magnetite, and which magnetite is available from Magnox, Inc., Wilmington, Del., and wherein the toner contains certain toner additives. In embodiments of the present invention, there are provided toners comprised of resin particles, magnetite particles, pigment particles of carbon black, charge enhancing additives, such as those comprised of the salts of RHODAMINE 6G™ such as the silico molybdate salt of RHODAMINE 6G™ available as FANAL PINK 4830™ from BASF Corporation, Clifton, N.J., pigments such as carbon black, wax, and surface additives of silica, especially fumed silicas available from Wacker Chemicals, or alumina; and magnetite. The addition of magnetites, such as soft magnetites like MAPICO BLACK®, to the surface of the magnetic toner, especially a MICR toner eliminates, minimizes, or reduces the formation of undesirable comets including especially comet formation on photoconductive imaging members, including flexible layered imaging members as illustrated, for example, in U.S. Pat. No. 4,265,990, the disclosure of which is totally incorporated herein by reference. In embodiments of the present invention, the magnetite is added to a toner containing magnetite during, for example, the preparation thereof, such as during the melt mixing toner processes and wherein the magnetite functions primarily as a lubricant. The toner compositions of the present invention in embodiments thereof possess excellent admix characteristics, maintain their triboelectric charging characteristics for an extended number of imaging cycles, and enable the elimination or minimization of undesirable comets on the imaging member or photoconductor. Developers of the present invention are comprised of the aforementioned toners and carrier particles, especially carrier particles comprised of a core with a mixture of polymers thereover. The toner and developer compositions of the present invention can be selected for electrophotographic, especially xerographic, imaging and printing processes, and preferably magnetic image character recognition processes (MICR), such as processes similar to those selected for the Xerox Corporation 8790/9790 MICR machines, and preferably the Xerox Corporation 4135® MICR test fixture or machine, and wherein personal checks with no, or minimal comets can be generated.

Toner and developer compositions with wax and certain surface additives, such as silicas, KYNAR®, or metal oxides, are known. Illustrated, for example, in U.S. Pat. No. 3,900,588 is a toner with surface additive mixtures of silica or strontium titanate and polymers like KYNAR®, see column 7, lines 12 to 17. This patent discloses, for example, a toner with a minor amount of a polymeric additive like KYNAR®, and a minor amount of an abrasive material, such as silica, like AEROSIL R972®. Toners and developers with surface additives of metal salts of fatty acids like zinc stearate and silica are known, reference for example U.S. Pat. Nos. 3,983,045 and 3,590,000. In U.S. Pat. No. 4,789, 613, there is illustrated a toner with an effective amount of, for example, strontium titanate dispersed therein, such as from about 0.3 to about 50 weight percent. Also disclosed in the '613 patent is the importance of the dielectric material with a certain dielectric constant, such as strontium titanate, being dispersed in the toner and wherein the surface is free or substantially free of such materials. Further, this patent discloses the use of known charge controllers in the toner, see column 4, line 55, olefin polymer, see column 5, line 35, and a coloring agent like carbon black as a pigment. Treated silica powders for toners are illustrated in U.S. Pat. No. 5,306,588. Toners with waxes like polypropylene and polyethylene are, for example, illustrated in U.S. Pat. Nos. 5,292,609; 5,244,765; 4,997,739; 5,004,666 and 4,921,771, the disclosures of which are totally incorporated herein by reference. Magnetic toners with low molecular weight waxes and external additives of a first flow aid like silica and metal oxide particles are illustrated in U.S. Pat. No. 4,758, 493, the disclosure of which is totally incorporated herein by reference. Examples of metal oxide surface additives are illustrated in column 5, at line 63, and include strontium titanate. Single component magnetic toners with silane treated magnetites are illustrated in U.S. Pat. No. 5,278,018, the disclosure of which is totally incorporated herein by reference. In column 8 of the '018 patent, there is disclosed the addition of waxes to the toner and it is indicated that surface additives, such as AEROSIL®, metal salts of fatty acids and the like, can be selected for the toner. Magnetic image character recognition processes and toners with magnetites like MAPICO BLACK® are known, reference for example U.S. Pat. No. Re. 33,172, the disclosure of which is totally incorporated herein by reference, and U.S. Pat. No. 4,859,550. The 33,172 patent also discloses certain toners with AEROSIL® surface additives. The toners and developers of the present invention may in embodiments be selected for the MICR and xerographic imaging and printing processes as illustrated in the U.S. Pat. No. 33,172.

Moreover, toners with charge additives are known. Thus, for example, there is described in U.S. Pat. No. 3,893,935 the use of quaternary ammonium salts as charge control agents for electrostatic toner compositions. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there are disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944, 493; 4,007,293; 4,079,014; 4,394,430 and 4,560,635 which illustrates a toner with a distearyl dimethyl ammonium methyl sulfate charge additive.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives. Further, TRH as a charge additive is illustrated in a number of patents, such as U.S. Pat. No. 5,278,018, the disclosure of which is totally incorporated herein by reference.

Toners with FANAL PINK® charge additives appear to be illustrated in U.S. Pat. Nos. 5,158,851 and 5,166,026, the disclosures of which are totally incorporated herein by reference. These patents appear to disclose FANAL PINK®, a rhodamine salt, as charge control agent for toners with a multiblock binder resin ('851 patent) and for semicrystalline olefin binder resin based toners ('026 patent). Also, U.S. Pat. No. 4,268,599 appears to indicate the use of RHODAMINE B® as a component for coating carrier to control charge to mass ratio on the carrier. BASF European publication EP 392356-B1 (90-314079/42) illustrates xanthene dyes, such as RHODAMINE®, in electrophotographic toners.

The disclosures of each of the patents mentioned herein are totally incorporated herein by reference.

Disclosed in U.S. Pat. No. 5,489,497, the disclosure of which is totally incorporated herein by reference, is a single component toner comprised of resin particles, magnetite treated, or coated with a phosphate titanium component wax, and surface additives comprised of mixtures of silicas and strontium titanate.

Disclosed in U.S. Pat. No. 5,482,805 and U.S. Pat. No. 5,486,443, the disclosures of which are totally incorporated herein by reference, is a toner comprised of resin particles, magnetite, carbon black, rhodamine charge additive, wax, and a surface mixture of silica, strontium titanate and polyvinylidene fluoride, and wherein comets are eliminated or minimized.

SUMMARY OF THE INVENTION

Examples of objects of the present invention include the following.

It is an object of the present invention to provide toner and developer compositions with many of the advantages illustrated herein.

In another object of the present invention there are provided MICR toner compositions with magnetites on the surface, and processes thereof, and wherein comet formation is minimized.

Also, in another object of the present invention there are provided MICR toner compositions with magnetites dispersed therein, and processes thereof, and wherein comet formation is avoided, or minimized.

In another object of the present invention there are provided toner compositions with wax, and certain charge additives, and a surface additive mixture comprised, for example, of silica and magnetite, and which toners are substantially insensitive to relative humidity, possess excellent admix characteristics, stable At properties, no evidence of comets when the toner is selected for the development of images after one million imaging cycles, or when the toner is tested in a Xerox Corporation 4135® aging fixture for 100 hours, and which toners are useful for the development of electrostatic latent images, or which toners can preferably be selected for MICR methods, and wherein personal checks with no or minimal comets are generated.

In yet another object of the present invention there are provided positive charged toner compositions with excellent admix, such as less than 15 seconds, and more specifically from greater than zero to about 15 seconds, and excellent stable triboelectric characteristics.

In yet a further object of the present invention there are provided positively charged toners, which admix in less than 15 seconds, that is, new toner added to developer in a Xerox Corporation MICR development apparatus, such as the Xerox Corporation 4135® test printer, will rapidly attain, within 15 seconds or less, the charge and charge distribution of the added new toner and with none or minimal increase in wrong sign, that is negatively charged toner.

It is a further object of the present invention to provide toner and developer compositions which, when used in a developing apparatus such as the Xerox Corporation 4135® MICR test printer, will exhibit excellent toner and developer flow characteristics.

In yet a further object of the present invention there are provided humidity insensitivity toners of, from about, for example, 10 to 90 percent relative humidity at temperatures of from 60° to 80° F. as determined by operating a Xerox Corporation 4135® test fixture printer apparatus in a relative humidity testing chamber and toners that enable developed electrostatic images with excellent lines and solids that do not exhibit, or have minimal smudge or background.

It is yet another object of the present invention to provide toner compositions wherein fused images generated therefrom are suitable for nonimpact MICR (magnetic image character recognition) applications wherein documents, such as checks with a xerographically printed MICR line, can be magnetically read and sorted with reliability in apparatus, such as the IBM 3890® reader/sorter, that is, after multiple passes through an IBM 3890® a minimal number of checks, less than 0.2 percent, are rejected because of smears or voids on the MICR line, and comets are avoided, or minimized.

Another important object of the present invention is to provide toners that enable developed images with no comets that, for example, obscure the image or character, and deposit on the photoreceptor or the substrate such as paper.

Moreover, in another object of the present invention there are provided processes wherein a soft magnetite like MAPICO BLACK® is added to a MICR toner, such as the Xerox Corporation 5090 MICR toner, during the melt mixing of the toner components, and wherein undesirable comets are avoided, reduced, or minimized on layered photoconductive imaging members comprised of a supporting substrate, a photogenerating layer, and an aryl amine hole transport layer, and wherein the added soft magnetite coats the photoconductive imaging member's surface and thereby prevents comet nucleation and tail growth. Similarly, comet formation can be avoided, or minimized by adding the soft magnetite to the MICR toner containing magnetite, and wherein the added soft magnetite coats the photoconductive imaging member's surface and thereby prevents comet nucleation and comet tail growth. In embodiments of the present invention, there is permitted a process wherein a continuous supply of magnetite is provided during development, transfer, and cleaning to thereby prevent cometing material from adhering to the layered photoconductive imaging member. In embodiments of the present invention, comet formation is significantly reduced for up to about 300,000 prints in the Xerox Corporation 4135 test fixture. Additionally, in another object of the present invention there are provided processes wherein a continuous supply of magnetite lubricant is provided to the spot blade edge as a homogeneous component of the toner particles. Comets, as referred to herein, refers in embodiments to copy deletions, and which comets can be formed by the micro tucking of xerographic urethane spot blade post cleaner system, and wherein, for example, surface additives like AEROSILS® are compressed on the photoreceptor surface; thus, subsequent photoreceptor revolution causes the compaction of toner in front of the comet site and grows to a printable defect; and this is avoided, reduced, or minimized with the present invention by utilizing a magnetite as a lubricant, such as a lubricant for the photoreceptor or for the xerographic spot blade. More specifically, in embodiments a continuous supply of lubricant magnetite is presented to the spot blade edge as a homogeneous component of the toner particles, and not as a surface additive, and wherein the soft magnetite is thermally attached to the toner composition and tumbles in front of the blade edge, breaking off, and coating the photoreceptor surface thereby, for example, decreasing the photoreceptor to blade friction and preventing micro blade tucking.

In embodiments, the toners of the present invention are comprised of resin particles, magnetite particles, waxes, and charge enhancing additives, and which toners contain surface additives comprised of a mixture of, for example, silica, especially fumed silicas, such as the AEROSILS® available from Degussa Chemicals, and magnetites, especially soft magnetites. More specifically, the present invention is directed to toner compositions, or particles comprised of resins, such as styrene methacrylates, styrene acrylates, styrene butadienes, polyesters, and the like, and preferably styrene butadienes, low molecular weight waxes, for example from about 500 to about 20,000 $M_w$ and preferably from about 1,000 to about 7,000 $M_w$(weight average molecular weight), magnetites, especially acicular magnetites, carbon black pigments like REGAL 330®, the positive charge additive FANAL PINK™, an insoluble salt of RHODAMINE 6G™ available from BASF, and a surface additive mixture comprised of silica, preferably fumed silica, and a soft magnetite. In embodiments, the soft magnetite is added to the surface of a MICR toner, or dispersed therein during the preparation of the toner.

In embodiments, the toners of the present invention are comprised of resin particles, magnetite particles, pigments of carbon black, waxes, and charge enhancing additives, and which toners contain surface additives comprised of a mixture of a fumed silica, or alumina, that is aluminum oxide, especially Alumina C-604 or Alumina C available from Degussa Chemicals, and soft magnetites. More specifically, the present invention is directed to toner compositions, or particles comprised of resins, such as styrene methacrylates, styrene acrylates, styrene butadienes, polyesters, and the like, and preferably styrene butadienes, low molecular weight waxes, for example from about 500 to about 20,000 $M_w$ and preferably from about 1,000 to about 7,000 $M_w$(weight average molecular weight), magnetites, especially acicular magnetites, carbon black pigments like REGAL 330®, the positive charge additive FANAL PINK®, an insoluble salt of RHODAMINE 6G™ available from BASF, and a surface additive of magnetite, or a surface additive mixture comprised of silica and magnetite.

Examples of resin particles present in various effective important amounts, such as from about 50 to about 75 and preferably from about 60 to about 70, and more preferably about 62 weight percent, include styrene butadiene copolymers, such as PLIOTONE®, and wherein the styrene is present, for example, in an amount of from about 60 to about 95 weight percent, and the butadiene is present in an amount of from about 5 to about 30 weight percent, and wherein the preferred ranges are from 80 to 90 weight percent of styrene and 10 to 20 weight percent of butadiene. These resins and certain polyesters provide toners that exhibit, for example, no, or minimal toner developed vinyl offset. Resin examples include copolymers of styrene and isoprene wherein the isoprene is present in an amount of from 10 weight percent to 16 weight percent; styrene copolymerized with one, two or more of the monomers methyl methacrylate, ethyl methacrylate, butyl methacrylate, isobutyl methacrylate, hexyl methacrylate, 2-ethyl hexyl methacrylate, or mixtures thereof; certain toner resins polyamides and certain toner resin polyimides.

In important embodiments of the present invention, there are provided processes for avoiding, reducing, or minimizing comet formation which comprises adding to the surface of a magnetic toner comprised of resin particles, magnetite, carbon black, optional charge additive, and wax, a surface mixture of silica, and magnetite; and to processes for avoiding, reducing, or minimizing comet formation which comprises dispersing in a magnetic toner comprised of resin particles, magnetite, carbon black, optional charge additive, and wax, a magnetite, and wherein the toner contains a silica surface additive.

Numerous well known suitable pigments can be selected primarily for enhancing the black color of the magnetites present. These pigments include carbon blacks, such as REGAL 330® and the like available from Cabot Corporation and Columbian Chemicals. The carbon black pigment is present in a sufficient effective amount, such as from about 1 percent by weight to about 5 percent by weight, and preferably from about 1 to about 3 weight percent based on the total weight of the toner components. In embodiments, it is important that the carbon black like REGAL 330® be present in an amount of about 3 weight percent.

Magnetites selected for the toner, preferably octahedral, spheroidal or acicular magnetites, include a mixture of iron oxides ($FeO.Fe_2O_3$) including those commercially available, such as ISK MO-4232, and which magnetites are present in the toner composition in an amount of from about 25 percent by weight to about 40 percent by weight, and preferably in an amount of from about 27 percent by weight to about 32 percent by weight so as to impart a magnetic retentivity of from 7 to 13 emu/gram of toner and preferably from 8.5 to 11 emu/gram of toner when measured at a 1,000 Oersted field strength in a vibration magnetometer such as VSM 155 or comparable device. Also, surface treated magnetites, such as those available from Toda Kogyo Inc., can be selected. These treated magnetites can contain coatings, such as phosphate, titanium or silane coupling agent components, in an amount, for example, of from about 0.5 to about 2 weight percent. Specific examples of untreated and treated magnetites that can be selected include Magnox Corporation MAGNOX B-350® and B-353®, ISK magnetics MO-4232®, HX-3204®, MCX-2096®, MO-7029® and MO-4431®, or Toda Kogyo Corporation MTA-740® or MTA-230®. Examples of surface treated magnetites include MO-7029® and MO-4431®. In embodiments of the present invention, the preferred magnetite is MAGNOX B-353® present in an amount of from about 27 to about 29 weight percent.

Surface additive magnetites, or magnetites added to the toner as indicated herein, include preferably soft magnetites like MAPICO BLACK®, MAGNOX B-350®, and the like, and which magnetites are selected in various effective amounts such as, for example, from about 0.1 to about 5, and preferably from about 0.1 to about 1 weight percent. When added to the toner during preparation, the magnetite is present in various effective amounts, such as for example from about 0.1 to about 5, and preferably from about 0.1 to about 1 weight percent. It is believed, although not desired to be limited by theory, that the soft magnetite forms a film on the photoconductive member and this film prevents comet nucleation and tail growth. Moreover, in embodiments of the present invention there are provided processes wherein magnetite is added to a photoconductor, or coated thereon to form a film, and wherein comets do not form. In embodiments, the external surface additive mixture includes colloidal silicas, such as AEROSIL®, or treated silicas, and magnetite. Each of the additives is present on the toner in important amounts, that is in embodiments of from about 0.1 to about 3 and preferably about 1 weight percent.

Waxes with a molecular weight of from about 500 to about 20,000, such as polyethylene, polypropylene, reference for example British Patent Publication 1,442,835, the disclosure of which is totally incorporated herein by reference, and paraffin waxes can be included in, or on the toner compositions in embodiments of the present invention primarily as fuser roll release agents and to avoid or minimize offset of the toner to paper. Examples of preferred waxes include crystalline polyethylene wax with a weight average molecular weight of from about 1,000 to about 3,000 like POLYWAX 1,000®, 2,000® and 3,000® as obtained from the Petrolite Corporation. Other suitable waxes can be Shamrock Chemicals Ceralube 363, Super Taber 5509, WEGO GT8520, and the like. Functionalized alcohol waxes, such as Petrolite Corporation UNILIN 425®, UNILIN 550® and UNILIN 700®, also can be selected, see U.S. Pat. No. 4,883,736, the disclosure of which is totally incorporated herein by reference. These waxes are present in various important effective amounts such as, for example, from about 3 to about 9 percent and preferably from about 4.5 to about 6 weight percent. One preferred wax is the highly crystalline polyethylene wax with a specific gravity of equal to or greater than 0.93, and which waxes are available from Petrolite Corporation. In embodiments, waxes, such as VISCOL 550™ and 660P™, are not preferred since these waxes may cause image smearing.

The charge additive, which is preferably contained in the toner, is preferably comprised of an insoluble salt of RHODAMINE 6G®, benzoic acid, 2-[6-(ethylamino)-3-(ethylimino)-3H-xanthen-9-yl] ethyl ester of the following formula/structure

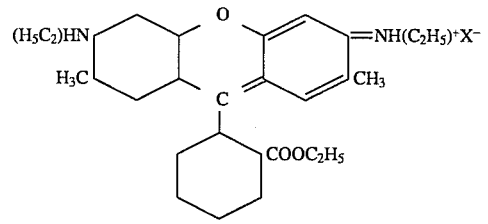

where X=silico molybdate, phosphomolybdate, phosphotungstmolybdate, the anion of copper ferrocyanic acid, and other effective known MICR charge additives.

The rhodamine salt charge additives can be obtained from BASF as FANAL PINK 4680®, 5460®, 5480® and preferably as FANAL PINK 4830®. The charge additive is present in an amount of from about 0.5 to about 5, and preferably from about 0.7 to about 1.5 weight percent. The preferred charge additive is wherein X is silico molybdate, that is FANAL PINK D 4830® obtained from BASF. Other charge additive salts that may be selected in embodiments include RHODAMINE 6G® salts derived from RHODAMINE B®, C.I. pigment Violet 1, such as ethanaminium, N-[9-(2-carboxyphenyl)- 6-(diethylamino)-3H-xanthen-3-ylidene]-N-ethyl phosophomolybdate; DDAMS; and the like.

Generally, the rhodamine salt charge additive selected for the toners of the present invention are represented by the following formula

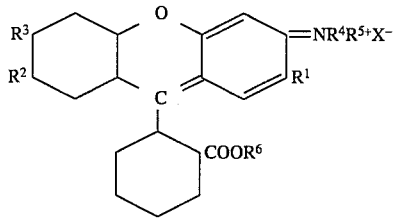

where:

$R^1$=H, or alkyl like —$CH_3$ $R^2$=H, or alkyl like —$CH_3$ $R^3$=—NH(alkyl like $C_2H_5$), or —$N(C_2H_5)_2$ $R^4$=H, or alkyl like —$C_2H_5$ $R^5$=—$C_2H_5$, —$C_6H_5$, —$C_6H_4SO_3$—, —$C_6H_3$—2, 6—$(CH_3)_2$ $R^6$ =H, $C_2H_5$ X=silicomolybdate, phosphomolybdate, phosphotungstmolybdate, or the anion of copper ferrocyanic acid.

The R substituents may be, as appropriate, alkyl, aryl, substituted alkyl, or substituted aryl, and the like in embodiments. Other known charge additives may be selected, it is believed, in embodiments of the present invention.

The toner of the present invention may be selected for use in electrostatographic imaging apparatuses containing therein conventional photoreceptors. Thus, the toner and developer compositions of the present invention can be used with layered photoreceptors, reference for example U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys; amorphous silicon; layered members comprised of photogenerating components like selenium; and charge transport molecules like aryldiamines, reference U.S. Pat. No. 4,265,990, the disclosure of which is totally incorporated herein by reference. For the layered flexible imaging members, photogenerating components include selenium, trigonal selenium, selenium alloys, phthalocyanines, chlorogallium phthalocyanines, titanyl phthalocyanines, and charge transport layers of aryl amines as illustrated in U.S. Pat. No. 4,265,990.

The toner compositions prepared by known melt blending processes, or by extrusion are usually jetted and classified subsequent to preparation to enable toner particles with a preferred average volume diameter of from about 5 to about 25 microns, and more preferably from about 8 to about 13 microns.

For the formulation of developer compositions, there are mixed with the toner particles of the present invention carrier components, particularly those that are capable of triboelectrically assuming an opposite polarity to that of the toner composition. Accordingly, the carrier particles of the present invention can be selected to be of a negative polarity enabling the toner particles, which are positively charged, to adhere to and surround the carrier particles. Illustrative examples of carrier particles include iron powder, steel, nickel, iron, ferrites, including copper zinc ferrites, magnetic iron oxides and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in embodiments in an amount of from about 0.1 to about 3 weight percent, conductive substances such as carbon black in an amount of from about 5 to about 30 percent by weight. Preferred are polymer coatings not in close proximity in the triboelectric series, reference U.S. Pat. Nos. 4,937,166 and 4,935,326, the disclosures of which are totally incorporated herein by reference, including, for example, KYNAR® and polymethylmethacrylate mixtures (40/60 to 55/45). Coating weights can vary as indicated herein; generally, however, from about 0.3 to about 2, and preferably from about 0.4 to about 1.5 weight percent coating weight is selected.

Furthermore, the diameter of the carrier particles, preferably nonspherical in shape, is generally from about 50 microns to about 1,000 microns and preferably from about 75 to about 150 microns, thereby permitting them to possess sufficient density and inertia to avoid adherence to the electrostatic images during the development process. The carrier component can be mixed with the toner composition in various suitable combinations, such as for example 1 to 6 parts per toner to about 100 parts to about 200 parts by weight of carrier.

In embodiments of the present invention, a test toner classified in a Donaldson Model B classifier was comprised of styrene/butadiene copolymer containing 90 percent by weight of styrene and 10 percent by weight of butadiene obtained from Goodyear Chemicals Corporation as PLIOTONE®, 29 percent by weight of the acicular magnetite MAGNOX B353®, the highly crystalline polyethylene wax POLYWAX 2000® as obtained from Petrolite Corporation and of a density greater than 0.93 gram/cc in an amount of 5.25 percent by weight, 1.0 percent by weight of the charge control agent FANAL PINK 4830®, the phosphomolybdate salt of Rhodamine obtained from BASF, 3 percent by weight of REGAL 330® carbon black obtained from Cabot Corporation, (micronization in a Sturtevant micronizer enabled toner particles with a volume median diameter of from 8 to 12 microns as measured by a Coulter Counter). There was added to the toner, and present on the surface thereof, by blending in a Lodige blender, 5 weight percent of the magnetite MAPICO BLACK®, and 1 weight percent of the fumed silica AEROSIL R972®. This resulting toner was incorporated into a Xerox Corporation MICR test fixture, and there were generated 100,000 developed prints and seven white dustings (the number of image frames per photoreceptor belt revolution). The test fixture also contained carrier particles comprised of an iron core, obtained from Hoeganaes Corporation, with 0.6 weight percent of a polymeric coating mixture of KYNAR 201® and polymethylmethacrylate in ratio of 48 weight percent of KYNAR® and 52 weight percent of polymethylmethacrylate (PMMA). No comets were observed visually on any of the copies, and no black specs where noted visually on any of the seven white dustings, indicating that no comets were present. Moreover, no comets were detected on the photoreceptor surface by microscopic magnification analysis. There was an absence of comets, as determined by microscopic examination, on the 100,000 MICR copies. The aforementioned photoreceptor was comprised of an aluminum supporting substrate; a polyester adhesive layer thereover; a photogenerating layer in contact with the adhesive layer, and which layer contained trigonal selenium photogenerating pigments; and as a top layer a hole transport layer comprised of the aryl amine molecules N,N'-diphenyl-N,N'-bis(methyl phenyl)-1,1-biphenyl-4,4'-diamine dispersed in MAKROLON®, a polycarbonate resin obtained from Larbensabricken Bayer A.G., prepared as disclosed in U.S. Pat. No. 4,265,990, the disclosure of which is totally incorporated herein by reference, and U.S. Pat. No. 5,189,155, the disclosure of which is totally incorporated herein by reference.

Testing of the above MICR toner without the magnetite on the surface thereof generated comets.

Also, it is believed that fused personal check images with magnetic characters thereon, that is personal checks with magnetic characters thereon, were of excellent quality, that is the check characters had high optical densities of greater than 1.3 (solid area image optical density) as measured on a Macbeth Densitometer, and very low development of toner in background areas, that is minimum background deposits. Periodic visual microscopic inspection of the photoreceptor will indicate, it is believed, no evidence of toner impacting onto the photoreceptor such as in small streaks of one millimeter or less, that is there was an absence of undesirable comets for 100,000 copies.

When 500 checks prepared from the aforementioned developer were passed through an IBM 3890® Reader/Sorter, toner offsetting to the protective foils on the write and read heads were absent as evidenced by visual microscopic inspection, and there was no image smearing on the checks. These checks were repeatedly passed through the IBM 3890® for an additional 10 passes after which, upon inspection of the protective foil, there was evidence of only slight contamination.

It is believed that similar results as indicated above can be obtained with toners containing magnetites dispersed therein.

Other modifications of the present invention may occur to those skilled in the art subsequent to a review of the present application, and these modifications, including equivalents thereof, are intended to be included within the scope of the present invention.

What is claimed is:

1. A process for avoiding, reducing, or minimizing comet formation in a magnetic image character recognition device which consists essentially of utilizing for the development of the magnetic characters a toner prepared by dispersing in a magnetic toner consisting essentially of resin particles, a first magnetite, pigment, charge additive, and wax, a second soft magnetite; and wherein the toner contains a silica surface additive, and wherein said charge additive is 2-[6-(ethylamino)-3-(ethylimino)-3H-xanthen-9-yl] ethyl ester.

2. A process for avoiding comet formation in a xerographic device that is used to prepare documents suitable for magnetic image character recognition systems consisting essentially of utilizing a developer composition consisting essentially of carrier particles and a toner consisting essentially of styrene, or polyester resin particles; acicular magnetite in an amount of from about 27 to about 32 weight percent; carbon black in an amount of from about 2 to about 3 weight percent; rhodamine charge additive in an amount of from about 0.7 to about 1.5 weight percent; low molecular weight wax, from about 1,000 to about 10,000 $M_w$, in an amount of from about 4.5 to about 6 weight percent; and surface silica in an amount of from about 0.5 to about 1 weight percent; and second magnetite in an amount of from about 1 to about 5 weight percent.

3. A process for avoiding or minimizing comet formation consisting essentially of dispersing in a magnetic toner consisting essentially of resin particles, a first magnetite, carbon black, charge additive, and wax, a second soft magnetite; and wherein the toner contains a silica surface additive, and wherein said charge additive is 2-[6-(ethylamino)-3-(ethylimino)-3H-xanthen-9-yl] ethyl ester.

4. A process in accordance with claim 1 wherein from about 1 to about 5 weight percent of second magnetite is present.

5. A process in accordance with claim 1 wherein from about 25 to about 70 weight percent of first magnetite is present.

6. A process in accordance with claim 1 wherein a magnetite film is formed on a photoconductive imaging member present in a magnetic image character recognition device.

7. A process in accordance with claim 1 wherein the second magnetite is the soft magnetite MAPICO BLACK®.

8. A process for avoiding comet formation in a xerographic device that is used to prepare documents suitable for magnetic image character recognition systems consisting essentially of dispersing in a magnetic toner consisting essentially of resin particles, a first magnetite, carbon black, charge additive, and wax, a second soft magnetite; and wherein the toner contains a silica surface additive, and wherein said charge additive is 2-[6-(ethylamino)-3-(ethylimino)-3H-xanthen-9-yl] ethyl ester of the formula

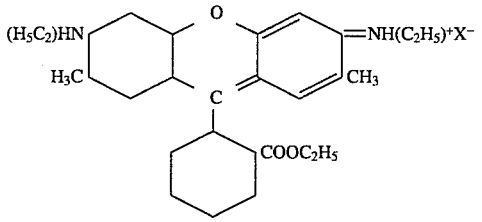

where X=silico molybdate, phosphomolybdate, phosphotungstmolybdate, or the anion of copper ferrocyanic acid.

9. A process in accordance with claim 8 which comprises providing the document desired, imprinting characters thereon with a high speed electronic printing device, and developing the characters with said toner.

10. A process in accordance with claim 8 wherein the documents are personal checks.

11. A process in accordance with claim 8 wherein the documents are personal checks, and the characters are generated by electrostatographic methods.

12. A process in accordance with claim 8 wherein from about 0.1 to about 3 weight percent of surface silica is present.

13. A process in accordance with claim 1 wherein the resin particles are styrene acrylates, styrene methacrylates, styrene butadienes, or polyesters, and the wax possesses a weight average molecular weight of from about 1,000 to about 7,000.

14. A process in accordance with claim 1 wherein the silica exhibits a BET surface area of about 150 $m^2$/gram, and said silica has been treated with a coating of N-2-aminoethyl-3-aminopropyl trimethyl silane and dimethyldichlorosilane.

15. A process in accordance with claim 1 wherein said wax has a weight average molecular weight of from about 1,000 to about 10,000, and is present in an amount of from about 3 to about 10 weight percent.

16. A process in accordance with claim 24 wherein said wax is selected from the group consisting of polyethylene and poly propylene.

* * * * *